US008453578B2

(12) United States Patent
Beutler

(10) Patent No.: US 8,453,578 B2
(45) Date of Patent: Jun. 4, 2013

(54) COASTER

(75) Inventor: Jörg Beutler, Holzkirchen (DE)

(73) Assignee: Joerg Beutler, Holzkirchen (DE)

( * ) Notice: Subject to any disclaimer, the term of this patent is extended or adjusted under 35 U.S.C. 154(b) by 107 days.

(21) Appl. No.: 12/842,050

(22) Filed: Jul. 23, 2010

(65) Prior Publication Data

US 2011/0017092 A1 Jan. 27, 2011

(30) Foreign Application Priority Data

Jul. 23, 2009 (DE) ..... 10 2009 026 241

(51) Int. Cl.
*A63G 1/00* (2006.01)

(52) U.S. Cl.
USPC ..... 104/53; 104/124; 104/63

(58) Field of Classification Search
USPC ..... 104/53, 54, 55, 56, 63, 64, 65, 124, 104/123, 125, 89, 94, 95, 288
See application file for complete search history.

(56) References Cited

U.S. PATENT DOCUMENTS

| | | | | |
|---|---|---|---|---|
| 5,272,984 | A * | 12/1993 | Bolliger et al. | 104/63 |
| 6,047,645 | A * | 4/2000 | Cornwell et al. | 104/124 |
| 6,158,354 | A * | 12/2000 | Eiraku | 104/53 |
| 6,269,749 | B1 * | 8/2001 | Hogg | 104/53 |
| 6,269,750 | B1 * | 8/2001 | Cornwell et al. | 104/53 |
| 6,523,479 | B1 * | 2/2003 | Schilke et al. | 104/57 |
| 6,550,392 | B2 * | 4/2003 | Albrich | 104/89 |
| 7,980,181 | B2 * | 7/2011 | Heaslip et al. | 104/63 |
| 2001/0037745 | A1 * | 11/2001 | Mares | 104/76 |
| 2009/0013899 | A1 * | 1/2009 | Wolf et al. | 104/288 |
| 2011/0017092 | A1 * | 1/2011 | Beutler | 104/53 |

* cited by examiner

*Primary Examiner* — Jason C Smith
(74) *Attorney, Agent, or Firm* — Edwards Wildman Palmer LLP

(57) ABSTRACT

A coaster according to the invention includes a track (10) and a vehicle (20). The track (10) includes a first support rail (11) and a second support rail (12). The first support rail (11) and the second support rail (12) are disposed vertically below the passenger receiver of the vehicle (20). Each of the bogies (23) and (24) includes a plurality of first rollers (25) and second rollers (26), wherein the second rollers (26) contact the second support rail (12) and prevent a lateral tilting of the vehicle relative to the plane (E) defined by the first support rail (11) and the second support rail (12). The first support element (11) and the second support element (12) are configured tubular.

19 Claims, 1 Drawing Sheet

COASTER

FIELD OF THE INVENTION

The present invention relates to a coaster, including: a vehicle with a passenger receiver for receiving at least one passenger; a track along which a vehicle is moveably disposed, wherein the track includes a first support element for supporting the weight of the vehicle and for retaining the vehicle on the track, wherein the first support element is disposed at a first distance from the passenger receiver below the passenger receiver.

BACKGROUND OF THE INVENTION

Coasters like roller coasters typically include one or plural rail supported vehicles which are being moved along a track. Typically, a double rail is being used as a support device, which defines the track and supports the vehicle in an intended position. In order to increase the thrill and the suspense for the passengers, various track layouts can be implemented.

However, it is hardly possible to integrate the configuration of a roller coaster of this type into an existing landscape or environment. Furthermore, the passengers always see the rails along which they are moving and can thus easily anticipate the track layout.

An option to configure the rail configuration less conspicuous includes using a monorail track. However, the problem with this solution is that the options for variable track layouts with complex track figured are limited for conventional monorail coasters.

The document U.S. Pat. No. 6,269,760 B1 illustrates a rail track with two rails disposed vertically on top of one another. The rails or the suspension are conventional roller coaster rails or suspensions which are only rotated by 90° compared to a conventional roller coaster. The vehicles are configured as outriggers. This way, there is an option to implement two track paths in a single configuration which in particular saves support beams.

OBJECT OF THE INVENTION

Thus, it is the object of the present invention to propose a coaster which can be integrated into the environment in an inconspicuous and space saving manner and which simultaneously offers greater flexibility with respect to configuring the track layout.

TECHNICAL SOLUTION

The object is accomplished through a coaster according to claims 1, 2 and 21. Advantageous features and preferred embodiments can be derived from the dependent claims.

A coaster according to the invention includes: A vehicle with a passenger receiver for receiving at least one passenger; a track along which the vehicle is moveably disposed, wherein the track includes a first support element for supporting the weight of the vehicle and for retaining the vehicle on the track, wherein the first support element is disposed at a first distance from the passenger receiver below the vehicle. The track includes a second support element for supporting the vehicle against a lateral tilting relative to the plane formed by the first support element and the second support element, wherein the second support element is disposed below the passenger receiver at a second distance from the passenger receiver below the passenger receiver. The first support element and the second support element are configured tubular. The combined center of gravity of the passenger receivers is disposed above the second support element and essentially in the plane defined by the first support element and the second support element.

A second tube is used instead of a support plate used for conventional monorail coasters, wherein the second tube is either directly attached to the first tube or offset through transversal beams, but connected to the first tube in a rigid manner in order to prevent a lateral tilting of the vehicle. The tubes can in particular be offset relative to one another in a vertical direction. The tubes can be bent in all directions and thus facilitate a more variable and more advanced three dimension track layout, e.g. vertical jumps (camelbacks), etc.

The combined center of gravity of the passenger receiver (s) is in particular a center of gravity of one or plural unoccupied passenger receivers. However, also the combined center of gravity of the passenger receivers of a vehicle and of the passengers operatively received in the passenger receiver can be considered as a center of gravity. The passengers are advantageously always placed, so that the combined center of gravity is disposed in a plane defined by the rails. The passenger receiver in this sense is the seat or the seat cavity in which the passenger is seated.

The center of gravity is disposed proximal to the support elements at least above the lower support element, mostly also above the upper support element and essentially in a plane of symmetry which is defined by the two support elements. The plane defined by the support elements is defined so that sections of the support elements disposed in parallel at least over a particular track section define a plane. Thus, the forces impact a passenger in a similar manner like driving a go cart. The core idea of the invention is to create a new driving sensation in that the support element is e.g. between the legs of the passenger which creates a driving sensation with an extremely low center of gravity.

In the art similar coasters with low center of gravity are known, however a tube with a rib welded thereto is used as a support element. Using two tubes according to the present invention, however, facilitates fabricating three dimensional turns in a simpler manner, since tubes can be bent about two axes. Furthermore, better driving properties are achieved through the distance of the tubes and through the track width, which is thus increased.

Another embodiment of the coaster according to the invention includes: a vehicle with a passenger receiver for receiving at least one passenger; a track, along which the vehicle is moveably disposed, wherein the track includes a first upper support element for supporting the weight of the vehicle and for retaining the vehicle on the track, wherein the first support element is disposed at a first distance from the passenger receiver below the passenger receiver, wherein the track includes a second lower support element for supporting the vehicle against lateral tilting relative to the plane formed by the first support element and the second support element, wherein the second support element is disposed at a second distance from the passenger receiver below the passenger receiver, the first support element and the second support element are configured tubular and the passenger receiver is disposed above the upper support element.

The track is configured in principle as a monorail, since the first support element bears the main load, while the second support element, which may be configured weaker and/or sized smaller, hardly bears any load but primarily defines and controls the orientation of the vehicle with respect to a lateral tilting relative to a plane defined by the support elements as a function of the position of the vehicle on the track. The second support element prevents a lateral tilting of the vehicle. Since the upper support is used mostly or exclusively for receiving the weight, the supports can be configured differently according to their functions.

Through the additional tube which is only used for directional support, differently from conventional monorails, no support plate is required. Support plates are typically mounted to the rail in order to prevent a lateral tilting of the vehicle. These support plates, however, can only be bent about one axis, so that particular more complex track layouts cannot be implemented. The second tube provided according to the invention can be disposed directly at the first rail or the first tube or disposed offset thereto through transversal beams.

By disposing two preferably tubular support elements which are disposed below one another, more complex three dimensional track layouts with randomly combinable inclines, turns or rotations of the vehicle about the first support element can be implement, thus e.g. also vertical jumps, camelbacks, since the support elements can be disposed in any orientation parallel to one another.

According to the invention the passenger receiver is disposed above the two support elements from a point of view of a passenger operatively received in the vehicle or in the passenger receiver. The center of the gravity of the loaded or unloaded vehicle or of the occupied or unoccupied passenger receiver is always disposed above and as close as possible to the first and/or second support element. Thus, a seat arrangement can be provided in which at least one of the rails (first and/or second support element) is disposed between the legs of the passenger, or at least one of the rails (first and/or second support element) is disposed between two seats disposed proximal to one another.

The support elements are preferably disposed below one another below the vehicle receiver, thus the space requirement for the coaster is small and the coaster can be integrated into the landscape inconspicuously, which differs from a track with rails made from two parallel driving tubes. Furthermore, there is an option to position a passenger low. Through the low positioning of the center of gravity the resulting moments can be kept low which favorably influences the structural configuration of the track and also the driving sensation. The center of gravity of the loaded and/or unloaded vehicle and of the occupied and/or the unoccupied passenger receivers, however, is always above the first and/or the second support element. Simultaneously, the track layout can be configured in a flexible manner like for conventional two beam rails.

The invention provides a transport system for a rail bound amusement park- or roller coaster. The basic principle however can also be used for passenger transport systems for e.g. rail bound vehicles with battery driven self propulsion.

Instead of the tubes, also solid rails or semi tubular rails can be used to practice the invention where this makes sense from a dimensional point of view, e.g. for a second support element with smaller diameter. Furthermore the term "tube" is not limited to tubes with circular cross section, but includes tubes with all possible cross sections that provide good bendability of the tubes. These are in particular cross sections without edges, e.g. circular or oval cross sections. According to the invention the term "tube" includes all cross sections with good bendability.

Preferably, the second distance is greater than the first distance. Alternatively thereto, however, also the second distance can be smaller than the first distance. Thus, the first support element can be disposed above or below the second support element. In particular, the support elements can be disposed in a vertical plane in a basic orientation of the vehicle relative to or below the vehicle receiver. The support elements can be offset from one another at a distance which exceeds the sum of the radii of the support elements, e.g. they can be connected through connection elements. However, they can also be disposed at a distance which approximately corresponds to the sum of the radii of the support elements, this means the support elements are in contact with one another, the cross section is similar to a figure eight or at a smaller distance, so that when the support elements are configured tubular, an outer surface is created which corresponds to an outer contour of two intersecting circles.

Preferably, the vehicle or the vehicle receiver is configured substantially symmetrical to the plane formed by the first support element and the second support element and disposed symmetrical at the track.

In a particularly preferred embodiment, the center of gravity is disposed in a portion between the first support element and the second support element.

In particular the vehicle can include an assembly of first rollers, which interact with the first support element.

At least one of the first rollers can be disposed for supporting at least a portion of the weight of the vehicle and at least the second of the first rollers can be disposed for retaining the vehicle on the track. These rollers of the first group take over the task of a support rail which supports the weight of the vehicle, prevents the vehicle from lifting off the track and steers the vehicle through the turns in the track. Only a lateral tilting of the vehicle about an axis which extends at a level of the first support element parallel to the driving direction can be prevented through the group of first rollers. In principle, the vehicle is disposed at the first support element, so that the vehicle is rotatable about said axis, this means when no other supporting components are provided.

In particular, the assembly of first rollers is disposed, so that a translatoric movement of the vehicle in a plane (F) perpendicular to a movement direction (v) of the vehicle relative to the first support element is prevented. Accordingly, the rollers contact the first support element, so that translatoric forces are transferred into the rails which come from various directions in the plane F.

The assembly of first rollers is connected to the first support element, in particular so that the assembly is rotatable in a plane perpendicular to the movement direction of the vehicle. Monorail coasters always require a support which prevents a lateral tilting of the vehicle relative to the first support rail. For conventional coasters, this is typically a support plate, a blade or similar. However, these retaining- or support devices which are connected to the first rail cannot be bent in random directions, so that the flexibility with respect to the track layout is limited.

Preferably, the vehicle includes an assembly of second rollers which interact with the second support element. Typically, these rollers prevent an unintentional lateral tilting of the vehicle in a plane aligned perpendicular to the driving direction. For a movement of a vehicle along the drive track, however, a lateral tilting relative to a horizontal normal position of the vehicle can be desirable as a function of a location in order to implement particular track figures. The two support elements can be disposed along the track so they are twisted in alignment with one another, or so that they are twisted relative to one another. The rollers engage the second support element laterally or laterally at a slant angle relative to the reference coordinate system of the vehicle.

The vehicle can include at least a first bogie and/or a second bogie, wherein the first bogie and/or the second bogie respectively comprise an assembly of first rollers and an assembly of second rollers, which are essentially connected with one another in a rigid manner. The bogies are preferably respectively connected with the vehicle in a rotatable manner, so that the vehicle can drive through turns. The at least one passenger receiver is disposed at the vehicle.

The assembly of second rollers can interact with the second support element, so that a rotation of a first bogie or of a second bogie in a plane perpendicular to the movement direction of the vehicle about the first support element is prevented. This relates to a situation where the vehicle is disposed at one location of the track. A lateral rotation of the bogies relative to the reference system earth, however, can be performed as a function of a location when a movement in driving direction occurs, wherein, however, the orientation is precisely defined as a function of a location.

Thus, the assembly of second rollers can interact with the second support element, so that a rotation of the first bogie or the second bogie about the first support element is defined through the relative position of the second support element relative to the first support element for a movement of the vehicle in movement direction.

The assembly of second rollers can include at least one roller on both sides of the plane defined by the first support element and the second support element, wherein the roller is disposed laterally at the second support element. Also the wheel arrangement or the suspension are adapted to particular requirements that need to be complied with by a monorail coaster in combination with a low center of gravity of the vehicle or the passenger receiver proximal to the rail.

The coaster preferably includes a passenger receiver for at least one passenger, wherein the passenger receiver is configured, so that the first support element and/or the second support element is or are disposed between the legs of an operatively received passenger. This provides the option to position the passenger or the center of gravity of the loaded vehicle or the occupied or unoccupied passenger receivers low, so that the resulting moments are small. This is advantageous for the structural design of the track and for the driving sensation.

In a preferred embodiment of the invention, the passenger receiver can include at least one seat surface for a passenger and the passenger receiver can be disposed, so that the plane defined by the two driving tubes intersects the sitting surface. Thus, the seated passenger is disposed directly above the upper support tube.

In another embodiment, the vehicle can include at least two passenger receivers respectively for at least one passenger, wherein the passenger receivers are disposed, so that the first support element and the second support element are disposed between the passenger receivers. Thus, the passenger receivers are disposed adjacent to one another relative to driving direction.

Preferably, the legs of two passengers, who are received in passenger receivers disposed adjacent to one another, are respectively disposed laterally with respect to at least the first support element. Thus, also for this embodiment the center of gravity is positioned low.

The first support element and the second support element can be integrally configured as an element, or they can be configured as two or plural components. For a one piece (integral) element, the cross section of the element is configured, so that contacting rollers always prevent a translatoric movement of the vehicle in a plane perpendicular to the movement direction of the vehicle and rollers are simultaneously provided which prevent a lateral tilting of the vehicle in said plane for a particular position of the vehicle along the track. Lateral tilting of the vehicle can be generated for a movement along the track through windings of the element. In particular a first assembly of rollers and a second assembly of rollers interact with the element, so that the arrangement of first rollers relative to a translatoric movement of the vehicle in a plane perpendicular to the movement direction of the vehicle engages the first support element and the assembly second rollers interacts with the element, so that a rotation of the first bogie or of the second bogie is defined by the degree of winding of the element for a movement of the vehicle in movement direction.

Preferably, the space between the first support element and the second support element is used for installations like cables, propulsion devices, brakes and vehicle control devices.

In another embodiment a coaster includes a vehicle with a passenger receiver for receiving at least one passenger; a track along which the vehicle is moveably disposed, wherein the track includes a first upper support element for supporting the weight of the vehicle and for retaining the vehicle on the track, wherein the first support element is disposed at a first distance from the passenger receiver below the passenger receiver, wherein the track includes a second lower support element for supporting the vehicle with respect to a lateral tilting relative to the plane formed by the first support element and the second support element, the second support element is disposed at a second distance from the passenger receiver below the passenger receiver, the first support element and the second support element are configured tubular and at least the first element is disposed between the legs of a passenger operatively received.

The system can be used for all kinds of transportation applications besides roller coasters. The vehicle can be moved along the track in different manners, e.g. through chain drives which move the vehicle to an elevated point in the track and subsequent acceleration through gravity, driving with an electric motor provided in the vehicle possibly also an energy accumulator, through drives disposed along the drive track, e.g. inductive drives (launch drives). All other suitable drives can be used to practice the invention.

Patent protection is requested for all recited features by themselves and also in combination with one another.

BRIEF DESCRIPTION OF THE DRAWINGS

Other advantages and features of the invention become apparent from the description of preferred embodiments and with reference to drawing figures, wherein.

DESCRIPTION OF PREFERRED EMBODIMENTS

Figure 1:
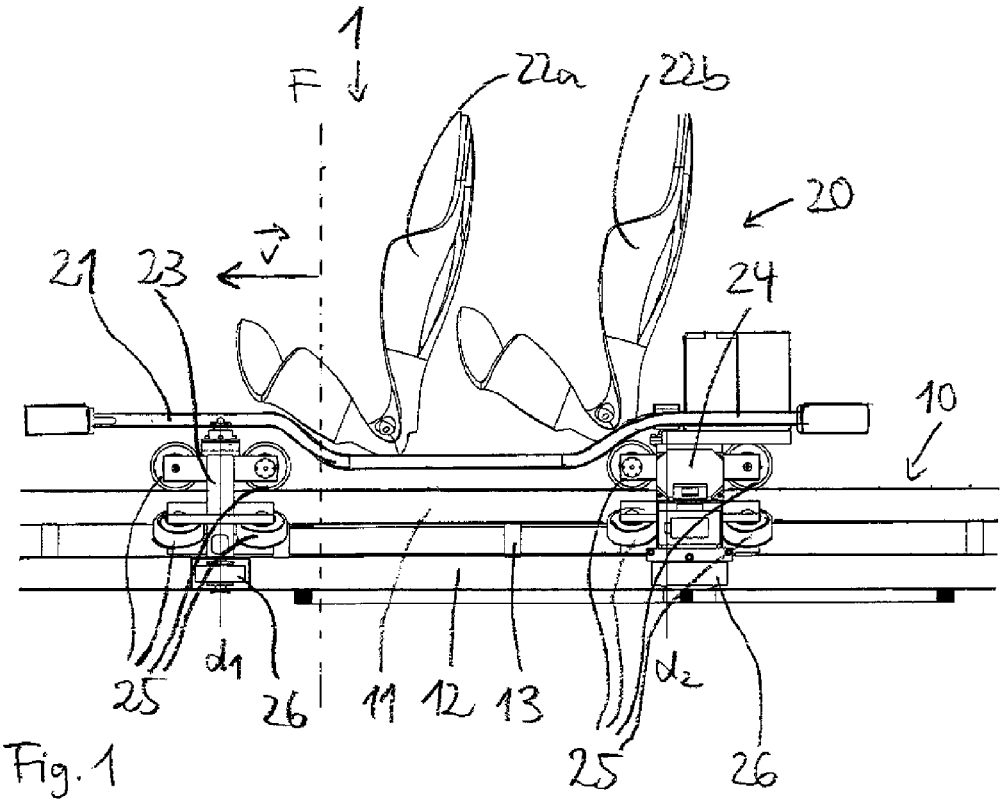
FIG. 1 illustrates a schematic lateral view of a section of the coaster according to the invention.

FIG. 1 illustrates a schematic lateral view of a section 1 of the coaster according to the invention.

The coaster includes a track 10 and a vehicle 20. The vehicle 20 is moveable along the track 10 (velocity vector v) and connected to the track.

Figure 2:
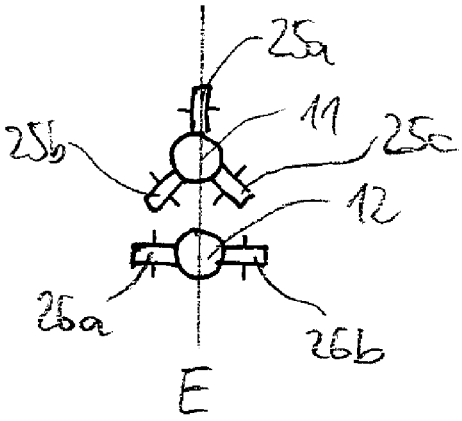
FIG. 2 illustrates a top view of components of the track and the vehicle in a sectional view

The track 10 includes a first support rail configured as a first tube 11 and a second support rail configured as a second tube 12. The first support rail 11 and the second support rail 12 are disposed at different distances from the vehicle 20 according to the point of view of a passenger received in the vehicle 20. In particular, they are not disposed adjacent to one another but vertically below the passenger receiver of the vehicle 20 or below one another and below the passenger receiver. Between the support rails 11 and 12 which are disposed parallel to one another and parallel to the movement direction v of the vehicle 20, a distance is provided which remains constant along the track. However, when track figures are formed in which the vehicle 20 is rotated laterally relative to the movement direction v, the plane E defined by the support rails 11 and 12 (cf. FIG. 2) can be rotated, this means from an absolute point of view the support rails 11 and 12 can change their positions along the track 10 relative to one another at will. The distance between them always remains constant. The vehicle 20 also co-rotates laterally with a rotation of the plane E. The first support rail 11 and the second support rail 12 are fixated to one another with a distance there between through connection elements 13 disposed along the track 10. The first support rail 11 is always the support rail which faces the vehicle 20 or the passenger receivers 22*a*, 22*b* (support rail proximal to vehicle), the second support rail 12 is always the support rail distal from the vehicle 20 or the passenger receivers 22*a*, 22*b*.

The vehicle 20 includes a suspension 21 and passenger receivers connected therewith, e.g. seats 22*a* and 22*b*. In the front portion of the suspension 21 a front bogie 23 is attached rotatable about an axis $d_1$, in the rear portion of the vehicle 21 a rear bogie 24 is attached rotatable about an axis $d_2$. Passenger receivers in the sense of the invention are the seats 22*a*, 22*b*, in particular the sitting surfaces or cavities 22*a*' or 22*b*', on which the passenger takes a seat. The center of gravity of the occupied or unoccupied seats 22*a*, 22*b*, this means the combined center of gravity of the vehicle receivers is disposed approximately in the plane of the seat surfaces. Advantageously, the passengers are always placed, so that the combined center of gravity is disposed in the plane of the rails.

Each of the bogies 23 and 24 includes a plurality of first rollers 25 which contact the first support rail 11 proximal to the vehicle 20. As can be derived from FIG. 2, e.g. three positions 25*a*, 25*b*, 25*c* can be provided for the first rollers 25. The three positions 25*a*, 25*b*, 25*c* are aligned relative to one another, so that the first support rail 11 supports the weight of the vehicle 20 and also prevents a lift off or a movement of the vehicle 20 relative to the track 10 in a different direction than the provided moving direction v. The first support rail 11 can be designated as support rail and/or retaining rail.

Furthermore, each of the bogies 23 and 24 includes a plurality of second rollers 26 which contact the second support rail distal from the vehicle. As evident from FIG. 2 e.g. two positions 26*a*, 26*b* can be provided for the second rollers 26. The two positions 26*a*, 26*b* are aligned opposite to one another relative to the second support rail 12. The second rollers 26 are in lateral contact with the second support rail 12. The assembly is selected, so that the second support rail 12 does not have to support any weight of the vehicle 20. The second support rail 12 is only used for preventing a lateral tilting of the vehicle relative to the plane E defined by the first support rail 11 and the second support rail 12. Thus, the second support rail 12 defines a lateral alignment of the vehicle 20 perpendicular to the movement direction v, wherein a lateral tilting of the vehicle 20 along the track 10 is caused by a change of a position of the plane E which is defined by the two support rails, and the respective lateral forces are transferred through the second rollers 26 onto the vehicle 20. The second support rail 12 can be considered a rail for lateral stabilization of the vehicle 20.

Both support rails 11 and 12 are configured tubular in the illustrated embodiment.

The two support rails 11 and 12 jointly define the absolute position of the bogie 20 at each point of the track. This enables a controlled support of the bogie 20 along the entire track. Through the configuration according to the invention not only simple turns or rotations of the vehicle 20 can be implemented in a plane perpendicular to the driving direction v, but also a combination of these movements with inclines and declining track sections can be implemented. Thus, also the configuration of complicated track layouts like coils, corkscrews, camelbacks, etc. is facilitated.

I claim:

1. A coaster (1), comprising:

a vehicle (20) with at least one passenger receiver for receiving at least one passenger;

a track (10) along which the vehicle is moveably disposed, wherein the track (10) includes a first support element (11) for supporting the weight of the vehicle (20) and for retaining the vehicle (20) on the track (10), wherein the first support element (11) is disposed at a first distance from the passenger receiver below the vehicle, wherein the track (10) includes a second support element (12) for supporting the vehicle against a lateral tilting relative to a plane (E) formed by the first support element (11) and the second support element (12), wherein the second support element (12) is disposed at a second distance from the passenger receiver below the passenger receiver, wherein the first support element (11) and the second support element (12) are configured tubular, and the combined center of gravity of the passenger receivers is disposed above the second support element (12) and essentially in the plane (E) defined by the first support element (11) and the second support element (12), wherein the vehicle (20) includes a vehicle receiver for at least one passenger, and wherein the vehicle receiver is configured so that the plane (E) formed by the first support element (11) and the second support element (12) is disposed between the legs of a passenger who is operatively received.

2. A coaster (1), comprising:

a vehicle (20) with at least one passenger receiver for receiving at least one passenger;

a track (10), along which the vehicle (20) is moveably disposed, wherein the track (10) includes a first upper support element (11) for supporting the weight of the vehicle (20) and for retaining the vehicle (20) on the track (10), wherein the first support element (11) is disposed at a first distance from the passenger receiver below the passenger receiver, wherein the track (10) includes a second support element (12) for supporting the vehicle against lateral tilting relative to a plane (E) formed by the first support element (11) and the second support element (12), wherein the second support element (12) is disposed at a second distance from the passenger receiver below the passenger receiver, the first support element (11) and the second support element (12) are configured tubular and the combined center of gravity of the passenger receivers is disposed above the upper support element (11), wherein the vehicle (20) includes a vehicle receiver for at least one passenger, and wherein the vehicle receiver is configured so that the plane (E) formed by the first support element (11) and the second support element (12) is disposed between the legs of a passenger who is operatively received.

3. The coaster (1) according to claim 1 or 2, wherein the second distance is greater than the first distance.

4. The coaster (1) according to claim 1 or 2, wherein the vehicle (20) is configured and disposed at the track (10) substantially symmetrical with respect to the plane (E) defined by the first support element (11) and the second support element (12).

5. The coaster (1) according to claim 3, wherein the combined center of gravity is disposed in a portion between the first support element (11) and the second support element (12).

6. The coaster (1) according to claim 1 or 2, wherein the vehicle (20) comprises an assembly of first rollers (25) which interact with first support element (11).

7. The coaster (1) according to claim 6, wherein at least a first roller (25*a*) of the first rollers (25) is disposed for supporting a portion of the weight of the vehicle (20) and at least a second roller (25*b*, 25*c*) of the first rollers (25) is disposed for retaining the vehicle (20) on the track (10).

8. The coaster (1) according to claim 7, wherein the assembly of first rollers (25) is disposed, so that a translational movement of the vehicle (20) in a plane (F) perpendicular to a movement direction (v) of the vehicle (20) relative to the first support element (11) is prevented.

9. The coaster (1) according to claim 7, wherein the assembly of first rollers (25) is connected to the first support element (11), so that the assembly of first rollers (25) is rotatable in a plane (F) perpendicular to a movement direction (v) of the vehicle (20).

10. The coaster (1) according to claim 1 or 2, wherein the vehicle (20) comprises an assembly of second rollers (26) which interact with the second support element (12).

11. The coaster (1) according to claim 10, wherein the vehicle (20) comprises at least a first bogie (23) including an assembly of first rollers (25) and an assembly of second rollers (26) which are essentially fixed to one another.

12. The coaster (1) according to claim 11, wherein the assembly of second rollers (26) interacts with the second support element (12), so that a rotation of the first bogie in a plane (F) perpendicular to the movement direction (v) of the vehicle (20) relative to the first support element (11) is prevented.

13. The coaster (1) according to claim 12, wherein the assembly of second rollers (26) interacts with the second support element (12), so that a rotation of the first bogie (23) about the first support element (11) is defined through a position of the second support element (12) relative to the first support element (11) for a movement of a vehicle (20) in a movement direction (v).

14. The coaster (1) according to claim 10, wherein the assembly of second rollers (26) on both sides of the plane (E) defined by the first support element (11) and the second support element (12) includes at least one roller (26*a*, 26*b*) laterally disposed at the second support element (12).

15. The coaster (1) according to claim 1 or 2, wherein the vehicle receiver comprises at least one sitting surface for a passenger and the passenger receiver is disposed, so that the plane (E) defined by the first and second support elements (11, 12) intersects the sitting surface.

16. The coaster (1) according to claim 1 or 2, wherein a space between the first support element (11) and the second support element (12) comprises at least one of a cable, a propulsion device, and braking and control devices for the vehicle.

17. The coaster (1) according to claim 1 or 2, wherein the first support element (11) and the second support element (12) can be integrally configured as an element (11, 12), wherein a cross section of the element (11, 12) is configured, so that a first assembly of rollers (25) and a second assembly of rollers (26) interact with the element, so that the assembly of first rollers (25) engages the first support element (11) relative to a translational movement of the vehicle (20) in a plane (F) perpendicular to the movement direction (v) of the vehicle (20) and the assembly of second rollers (26) interacts with the element (11, 12), so that a rotation of a first bogie (23) is defined by the degree of winding of the element (11, 12) for a movement of the vehicle (20) in a movement direction (v).

18. A coaster (1) comprising:

a vehicle (20) with at least two passenger receivers respectively for at least one passenger;

a track (10) along which the vehicle (20) is moveably disposed, wherein the track (10) includes a first upper support element (11) for supporting the weight of the vehicle (20) and for retaining the vehicle (20) on the track (10), wherein the first support element (11) is disposed at a first distance from the passenger receiver below the passenger receiver, wherein the track (10) includes a second lower support element (12) for supporting the vehicle with respect to a lateral tilting relative to a plane (E) defined by the first support element (11) and the second support element (12), the second support element (12) is disposed at a second distance from the passenger receiver below the passenger receiver, the first support element (11) and the second support element (12) are configured tubular; and wherein the vehicle receivers are disposed, so that the plane (E) formed by the first support element (11) and the second support element (12) is disposed between the passenger receivers.

19. The coaster (1) according to claim 18, wherein legs of passengers received in passenger receivers are disposed adjacent to one another and laterally with respect to at least one support element.

* * * * *